US008833211B2

(12) United States Patent
Chuang

(10) Patent No.: US 8,833,211 B2
(45) **Date of Patent: *Sep. 16, 2014**

(54) NON-RETURN RATCHET TYPE TORQUE SOCKET

(71) Applicant: Wei-Chieh Chuang, New Taipei (TW)

(72) Inventor: Wei-Chieh Chuang, New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/756,947

(22) Filed: Feb. 1, 2013

(65) Prior Publication Data

US 2014/0000420 A1 Jan. 2, 2014

(30) Foreign Application Priority Data

Jun. 29, 2012 (TW) ..... 101212557 U

(51) Int. Cl.

| | |
|---|---|
| ***B25B 23/14*** | (2006.01) |
| ***B25B 23/157*** | (2006.01) |
| ***B25B 23/142*** | (2006.01) |
| ***B25B 15/00*** | (2006.01) |

(52) U.S. Cl.

CPC ..... *B25B 23/141* (2013.01); *B25B 23/1427* (2013.01); *B25B 15/001* (2013.01)

USPC ..... 81/475; 81/467; 81/476

(58) Field of Classification Search

USPC ..... 81/475, 467, 476

See application file for complete search history.

(56) References Cited

U.S. PATENT DOCUMENTS

| | | | | |
|---|---|---|---|---|
| 2009/0255386 | A1* | 10/2009 | Liao | 81/474 |
| 2011/0094354 | A1* | 4/2011 | Lai | 81/475 |
| 2012/0240734 | A1* | 9/2012 | Chuang | 81/476 |

* cited by examiner

*Primary Examiner* — Monica Carter
*Assistant Examiner* — Danny Hong
(74) *Attorney, Agent, or Firm* — Guice Patents PLLC

(57) ABSTRACT

The present invention relates to a non-return ratchet type torque socket comprising a shaft rod and a shaft cylinder. A core shaft of shaft rod is sleeved with a mobile ratchet capable of axially moving; the shaft cylinder having a shaft slot formed for being sleeved with the core shaft; an accommodation slot is formed in the shaft slot thereby allowing the mobile ratchet to be accommodated; the interior of the accommodation slot is formed a fixed ratchet; a fixed ratchet teeth are mutually engaged with a mobile ratchet teeth; when the core shaft rotates in the shaft slot and the applied torque exceeds the preset torque value, the core shaft idly rotates in the shaft slot, the mobile ratchet teeth of the mobile ratchet are engaged and rotated along the fixed ratchet teeth of the fixed ratchet for axially and elastically moving so as to generate a sound.

8 Claims, 5 Drawing Sheets

A-A

NON-RETURN RATCHET TYPE TORQUE SOCKET

BACKGROUND OF THE INVENTION

1. Field of the Invention

The present invention relates to a torque socket, especially to a non-return ratchet type torque socket capable of having one end being sleeved with a manual, pneumatic or electric rotation tool and the other end being sleeved with a drive head.

2. Description of Related Art

Conventionally, a screwdriver is composed of a handle having a pre-determined length and a drive rod having a drive head, and generally the drive head can be formed in a flat or cross shape for mating with the flat or cross recessed slot formed on top of a screw, thereby locking or loosening a screw being able to be performed. Because the drive head of the mentioned screwdriver has fixed shape and dimension, a drive head having different shape and dimension cannot be used for replacement. In view of the disclosed shortage, skilled people in the art have developed a manual tool in which the drive head being able to be changed, e.g. a wrench; after the wrench is sleeved with a socket, an insertion slot formed at the bottom of the socket can be sleeved with drive heads having different shapes and dimensions, thereby being applicable regarding to various types of screws. However, the socket is only served as a tool for transferring the torque, the socket itself is not provided with a quantified torque mechanism.

When a conventional rotation tool such as a screwdriver or a wrench is used for adjusting the lens of an optical device such as a monitor, the torque value of the rotation tool is determined by the force applied by the user, so during the adjustment process, the lens may be broken due to the overly large torque, thereby causing enormous loss.

For preventing a user from applying the rotation force exceeding the tolerance range of a connection member, e.g. a screw, while using a rotation tool such as a screwdriver or a wrench to rotate the screw which causing the damage of the screw. As such, a screwdriver having a transmission structure installed with a spring and a steel ball is developed for limiting the output torque, when the mentioned screwdriver is in use, if the applied torque is overly large, the steel ball is separated from the spring thereby causing the screwdriver and the drive head to be separated, so an idle rotation state is formed between the screwdriver and the drive head. As such, the screwdriver can be controlled to only output the quantified torque thereby preventing the connection member from being damaged.

The screwdriver utilizing the spring and steel ball for transmission is able to control the torque to be quantified for outputting, however, a point contact state is formed while the spring and the steel ball being loosening from each other, such condition may cause the components more likely to be deformed and damaged, thus the limited output torque value is relatively unstable. In addition, because the transmission structure composed by the spring and the steel ball, the dimension of the screwdriver is not able to be effectively reduced, thus the mentioned screwdriver cannot be used for locking or adjusting a procession instrument.

In view of the shortages of the mentioned rotation tool, the applicant of the present invention has developed a torque socket entitled to the Taiwan Patent No. M414299 (corresponding to the China Patent No. CN201998113U, the U.S. patent application Ser. No. 13/310,766, the German Patent Application No. 102012005885.3 and the Japan Patent Application No. 2011-007636), in which a resilient core shaft formed on a shaft rod is sleeved in a shaft slot axially formed in a shaft cylinder, the shaft slot is a stepped hole having a dimension slightly smaller than the core shaft, a flange part radially and protrudingly formed at a distal end of the core shaft is buckled with a buckle part correspondingly formed in the shaft slot, and a friction segment capable of packing the core shaft is radially and protrudingly formed in the shaft slot, so the core shaft and the shaft slot are provided with a preset torque value; the other ends of the shaft rod and shaft hole are respectively formed with an insertion tenon used for being combined with a rotation tool and a sleeve slot used for being sleeved with a drive head.

During the screwing process of the torque socket, when the applied torque does not exceed the preset torque value of the socket, the screw can be further screwed in, when the screw has been rotated and positioned, and the applied torque has exceeded the preset torque value, the core shaft idly rotate in the shaft slot, thereby preventing the screw from being overly locked. However, while the torque socket being used for locking the screw, the socket itself does not generate any sound for informing the user the locking state has been reached. Moreover, while the torque socket being used for loosening the screw, if the combined force of the screw and the object to be combined is greater than the preset torque value of the torque socket, the core shaft can only idly rotate in the shaft slot and cannot be used for loosening the screw. As such, how to providing a function of generating a sound while the connection member being properly locked by the torque socket and a non-return function while the connection member being loosened are the issues that the applicant of the present invention desires to solve.

SUMMARY OF THE INVENTION

One primary objective of the present invention is to provide a non-return ratchet type torque socket, having a function of generating a sound while the applied torque exceeding a preset value or a connection member being locked and a non-return function while the connection member being loosened, wherein one end of the non-return ratchet type torque socket is sleeved with a manual, pneumatic or electric rotation tool and the other end is sleeved with a drive head, the present invention has improved the shortage a socket used in a rotation tool only capable of providing a function of being sleeved with a drive head having different shape and dimension.

For achieving the aforesaid objective, one solution of the preset invention is to provide a non-return ratchet type torque socket, which comprises:

a shaft rod, radially formed with a flange, two sides of the flange are respectively and axially extended with an insertion tenon having a noncircular cross section and a core shaft having a circular cross section, one surface of the core shaft is axially formed with at least a cut groove; the core shaft is respectively sleeved with a resilient member abutted against the flange, and a mobile ratchet capable of axially moving on the core shaft and radially annularly formed with unidirectional mobile ratchet teeth;

a shaft cylinder, two axial sides thereof are respectively formed with a shaft slot having a circular cross section and a sleeve slot having a noncircular cross section, the shaft slot is a stepped hole allowing the core shaft to be sleeved, and the interior thereof is radially formed with an annular friction segment capable of packing the core shaft, thereby forming a preset torque value between the core shaft and the shaft slot; an accommodation slot is formed between the opened end of the shaft slot and the friction segment thereby allowing the mobile ratchet to be accommodated, and the interior of the accommodation slot is formed a fixed ratchet radially and annularly formed with unidirectional fixed ratchet teeth, and the fixed ratchet teeth are mutually engaged with the mobile ratchet teeth;

when the core shaft rotates in the shaft slot and the applied torque exceeds the preset torque value, the core shaft idly rotates in the shaft slot, the mobile ratchet teeth of the mobile ratchet are engaged and rotated along the fixed ratchet teeth of the fixed ratchet for axially and elastically moving so as to generate a sound.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
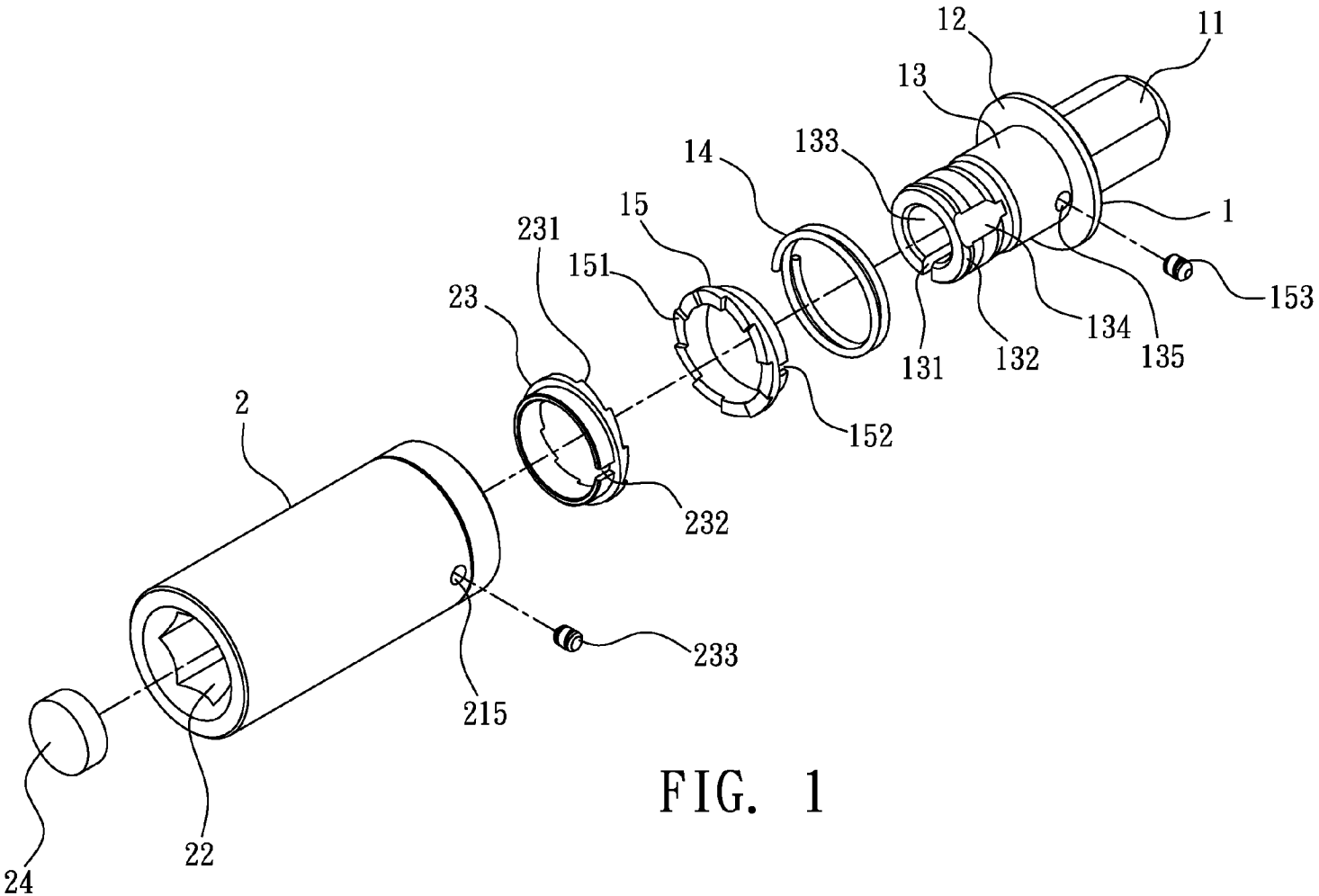
FIG. 1 is a perspective exploded view illustrating the non-return ratchet type torque socket being viewed from one angle, according to the present invention.
Figure 2:
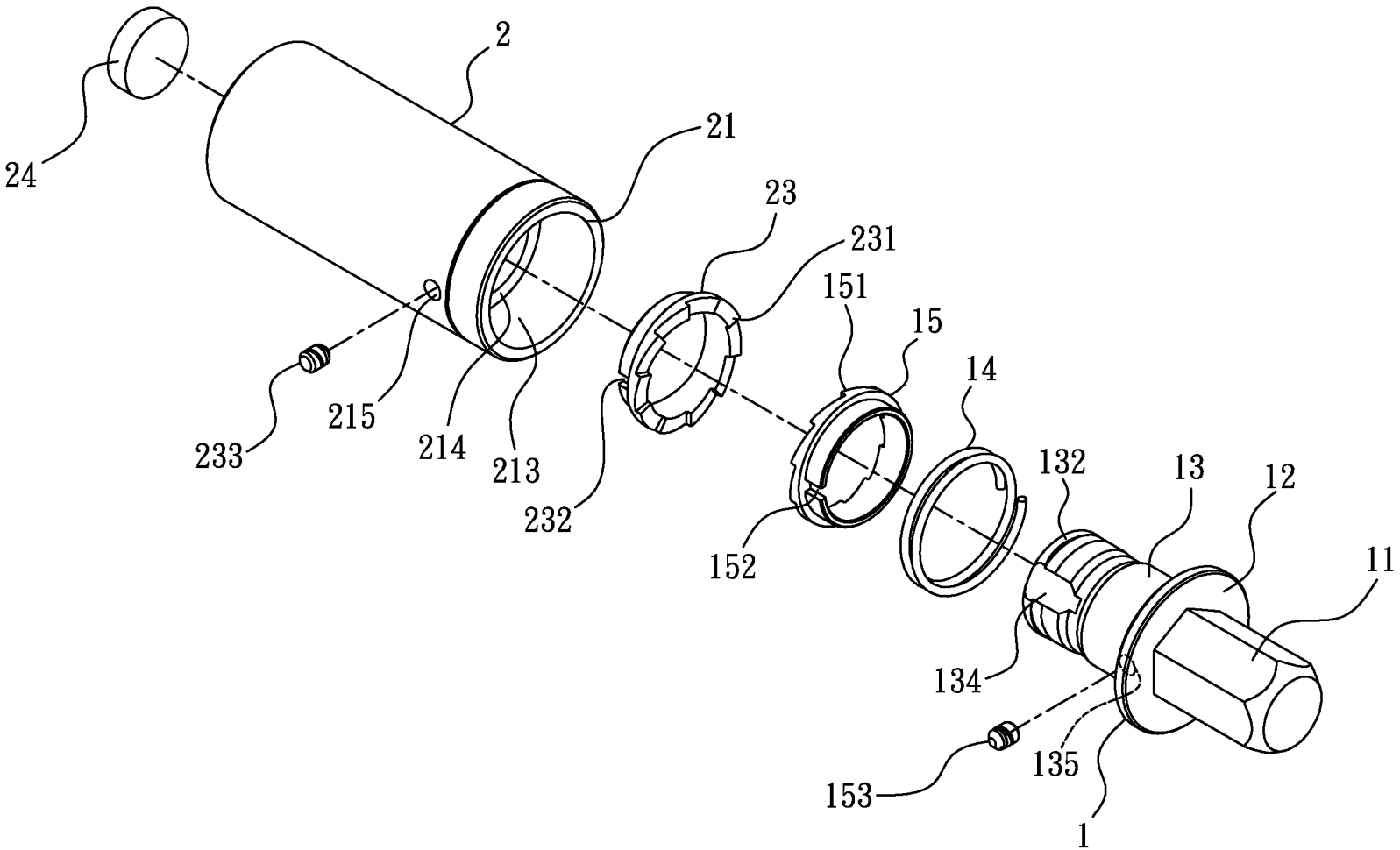
FIG. 2 is another perspective exploded view illustrating the non-return ratchet type torque socket being viewed from another angle, according to the present invention.
Figure 3:
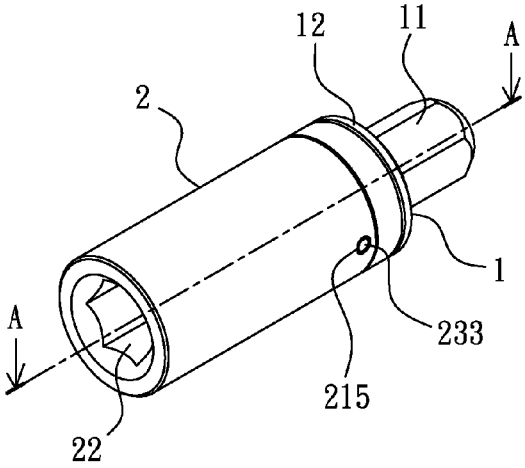
FIG. 3 is a perspective view illustrating the assembly of the non-return ratchet type torque socket, according to the present invention.
Figure 4:
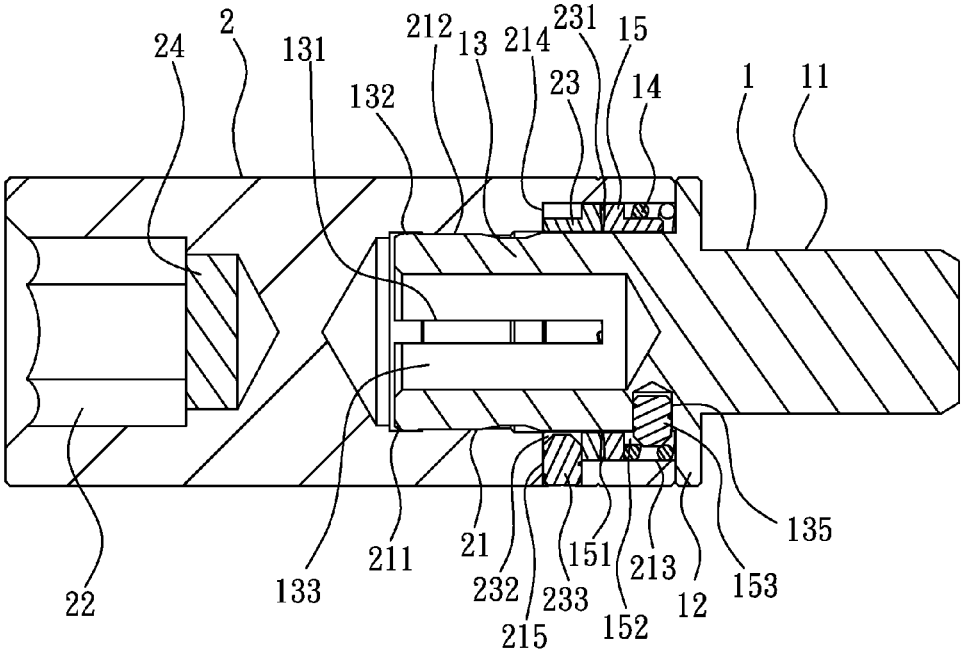
FIG. 4 is a cross sectional view of FIG. 3 taken along line A-A.
Figure 5:
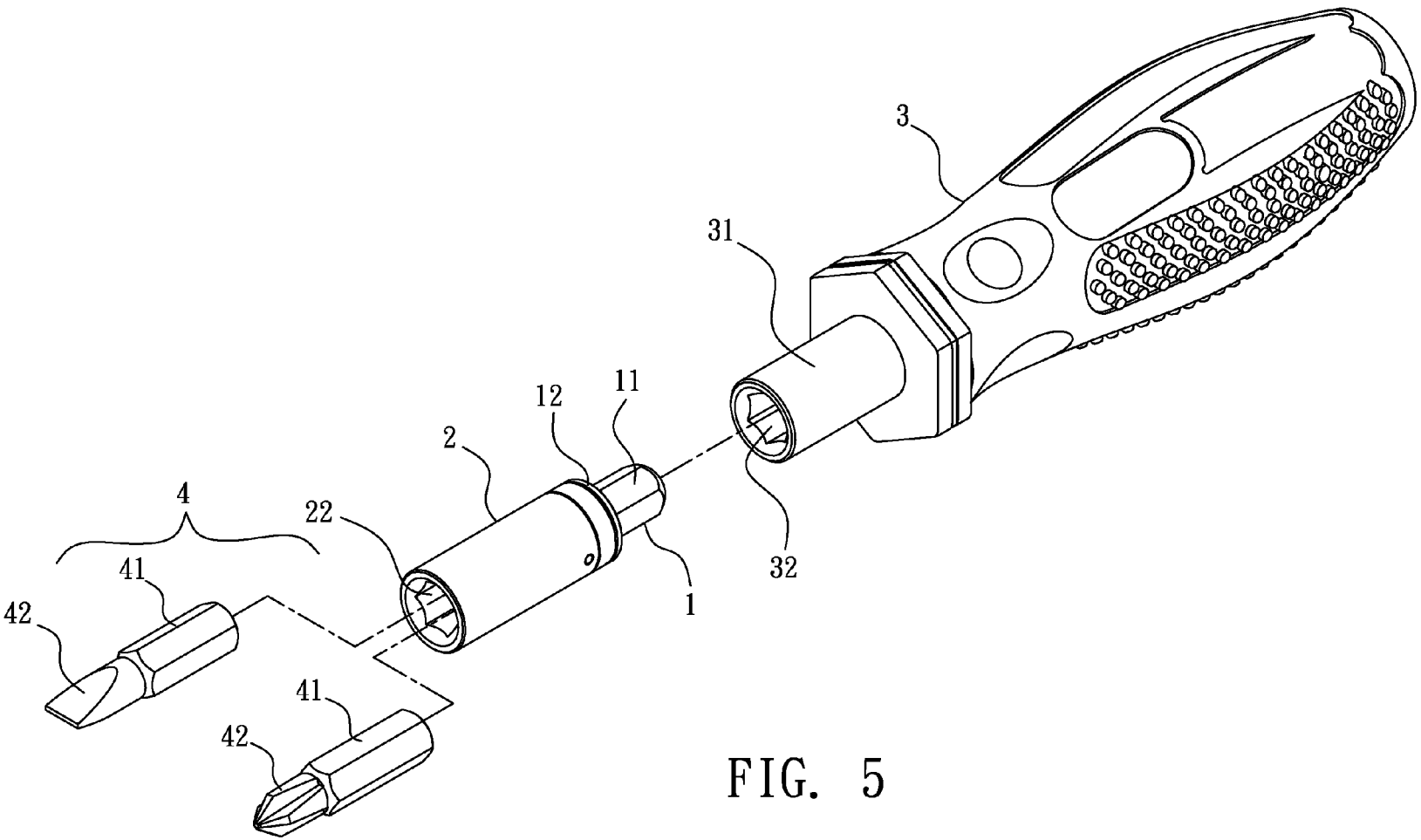
FIG. 5 is a perspective exploded view illustrating the non-return ratchet type torque socket, a rotation tool and a drive head, according to the present invention.
Figure 6:
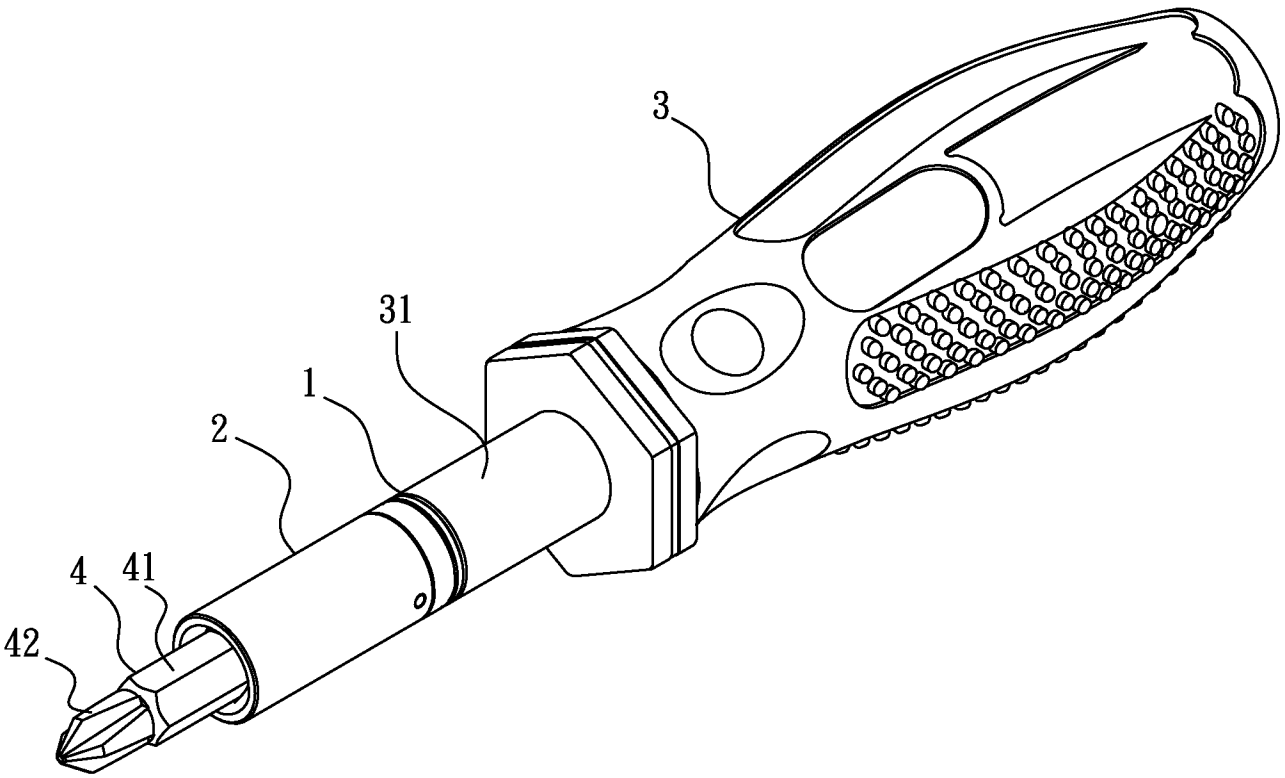
FIG. 6 is a perspective view illustrating the assembly of the non-return ratchet type torque socket, the rotation tool and the drive head, according to the present invention.

The accompanying drawings are included to provide a further understanding of the invention, and are incorporated in and constitute a part of this specification. The drawings illustrate embodiments of the invention and, together with the description, serve to explain the principles of the invention, wherein FIG. 1 is a perspective exploded view illustrating the non-return ratchet type torque socket being viewed from one angle, according to the present invention; FIG. 2 is another perspective exploded view illustrating the non-return ratchet type torque socket being viewed from another angle, according to the present invention; FIG. 3 is a perspective view illustrating the assembly of the non-return ratchet type torque socket, according to the present invention; FIG. 4 is a cross sectional view of FIG. 3 taken along line A-A; FIG. 5 is a perspective exploded view illustrating the non-return ratchet type torque socket, a rotation tool and a drive head, according to the present invention; and FIG. 6 is a perspective view illustrating the assembly of the non-return ratchet type torque socket, the rotation tool and the drive head, according to the present invention.

Referring from FIG. 1 to FIG. 4, the non-return ratchet type torque socket provided by the present invention comprises a shaft rod 1 and a shaft cylinder 2.

The shaft rod 1 is a rod member, one axial side thereof is formed with an insertion tenon 11 having a noncircular cross section, e.g. a hexangular cross section, the inner side of the insertion tenon 11 is radially formed with a flange 12 thereby enabling the flange 12 to be disposed adjacent to a rotation tool 3 shown in FIG. 5, such as an insertion slot 32 of a connection rod 31 formed at the bottom of a screwdriver handle or a shaft slot 21 of the mentioned shaft cylinder 2. Another side of the flange 12 is extended with a core shaft 13 having a circular cross section, one surface of the core shaft 13 is axially formed with at least a cut groove 131 thereby providing proper elasticity to the core shaft 13. One surface of the core shaft 13 is radially formed with a flange part 132, and the center thereof is formed with a shaft hole 133, wherein the shaft hole 133 is in communication with the cut groove 131 and the interior thereof is stored with lubrication oil, thereby allowing the lubrication oil to pass through the cut groove 131 for providing a lubricating effect. In addition, the periphery of the core shaft 13 is formed with an oil storage zone 134 through being milled by a miller for the purpose of oil storage thereby enhancing the smoothness while the core shaft 13 rotating in the shaft slot 21.

The technical feature of the core shaft 13 is that the inner side of the flange 12 is in sequence sleeved with a resilient member 14, e.g. a spring or a resilient disc, and a mobile ratchet 15 capable of axially moving on the core shaft 13, the inner and the outer side of the mobile ratchet 15 are respectively and radially installed with unidirectional mobile ratchet teeth 151 and axially formed with at least a position limiting slot 152, and a position limiting pin 153 is provided for penetrating the position limiting slot 152 and being inserted a first pin hole 135 radially preset on the core shaft 13. As such, with the disclosed structure, the mobile ratchet 15 is enabled to axially and elastically move on the core shaft 13.

The shaft cylinder 2 is a columnar member, two axial sides thereof are respectively formed with the mentioned shaft slot 21 having a circular cross section and a sleeve slot 22 having a noncircular cross section e.g. a hexangular cross section. The dimension of the shaft slot 21 is slightly smaller than that of the core shaft 13, thereby allowing the above two components to be connected and mounted by a conventional tightening means, so a rotation shaft structure having stopping and positioning effects is formed. Wherein, the shaft slot 21 is a circular stepped hole, the interior thereof is formed with a buckle part 211 corresponding to the position and the dimension of the flange part 132 of the core shaft 13. In addition, a lateral side of the buckle part 211 is adjacently provided with an annular friction segment 212, the friction segment 212 can be used for packing the surface of the core shaft 13 for forming a torque, so the torque can be adjusted to a preset torque value through altering the contact area defined between the friction segment 212 and the core shaft 13.

The technical feature of the shaft slot 21 is that an accommodation slot 213 is formed between the front opened end thereof and the friction segment 212 thereby allowing the mobile ratchet 15 to be accommodated, a fixed ratchet 23 is installed inside the accommodation slot 213, and the rear end of the fixed ratchet 23 is abutted against a stop flange 214 radially formed between the accommodation slot 213 and the friction segment 212, the inner and the outer side of the fixed ratchet 23 are respectively and radially and annularly formed with unidirectional fixed ratchet teeth 231 and axially formed with at least a positioning slot 232, a positioning pin 233 is provided for penetrating a second pin hole 215 radially preformed on the outer wall of the shaft slot 21 and being inserted in the positioning slot 232. As such, with the disclosed structure, the fixed ratchet 23 is enabled to be fixed in the accommodation slot 213 and prevented from rotating.

The sleeve slot 22 is used for sleeving and positioning a sleeve rod 41 of a drive head 4 shown in FIG. 5, in actual practice, the free end of the drive head 4 can be a tenon 42 having a flat, cross or other geometric shapes, the disclosed technique is well known by skilled people in the art so no further illustration is provided. For providing magnetic force to the drive head 4, a magnet 24 is installed in the sleeve slot 22, thereby providing the magnetic force to the sleeved drive head 4 for attracting a connection member made of a magnetic conductive material, e.g. a screw.

Referring from FIG. 1 to FIG. 4, when being assembled, the core shaft 13 of the shaft rod 1 is inserted in the shaft slot 21 of the shaft cylinder 2, so the flange part 132 of the core shaft 13 is buckled with the buckle part 211 of the shaft slot 21 thereby forming a buckling state, the shaft rod 1 and the shaft cylinder 2 are prevented from being axially separated. At this moment, due to the energy released by the resilient member 14, the mobile ratchet 15 sleeved with the core shaft 13 enables the unidirectional mobile ratchet teeth 151 of the mobile ratchet 15 and the fixed ratchet teeth 231 of the fixed ratchet 23 to be mutually engaged, thereby forming the non-return ratchet type torque socket as shown in FIG. 3 and FIG. 4.

As shown in FIG. 5, the insertion tenon 11 of the shaft rod 1 is inserted in the rotation tool 3, e.g. being inserted in the insertion slot 32 of the connection rod 31 at the bottom of the screwdriver handle, the sleeve slot 22 of the shaft cylinder 2 is sleeved with the selected drive head 4, thereby forming a combining state shown in FIG. 6. Wherein, the rotation tool 3 is not limited to the disclosed manual screwdriver handle, i.e. the non-return ratchet type torque socket of the present invention can also be applied in a pneumatic or electric rotation tool and the anticipated locking or loosening function can also be provided.

In actual practice of the present invention, the tenon 42 of the drive head 4 is aimed at a member to be combined, e.g. a connection member such as a screw recessed slot formed at the periphery of a monitor lens, then the rotation tool 3 is manually rotated, so the shaft rod 1 drives the shaft cylinder 2 and the drive head 4 to synchronously rotate, thereby performing the locking operation, during the screwing process, if the applied torque does not exceed the preset torque value of the torque socket, the screw can be further screwed in, when the screw has been rotated and positioned (locked) or the applied torque has exceeded the preset torque value, the core shaft 13 idly rotate in the shaft slot 21, so the mobile ratchet teeth 151 of the mobile ratchet 15 sleeved on the core shaft 13 are engaged and rotated along the fixed ratchet teeth 231 of the fixed ratchet 23 for axially and elastically moving so as to generate a sound for informing the user that the screw has already been in the locking state or the preset torque value has been reached, thereby preventing the lens from being squeezed and broken due to over screwing and locking.

As what has been disclosed above, the present invention has following advantages: the non-return ratchet type torque socket can prevent the applied torque from exceeding the tolerance range of the connection member while screwing is not properly performed, under such circumstance, the core shaft is enabled to immediately and idly in the shaft slot, meanwhile the mobile ratchet teeth of the mobile ratchet are driven to rotate along the fixed ratchet teeth of the fixed ratchet so as to generate a sound for informing, thereby unnecessary lost being avoided; moreover, the mobile ratchet teeth of the mobile ratchet and the fixed ratchet teeth of the fixed ratchet are unidirectionally and mutually engaged, thereby providing a non-return function and facilitating the loosening operation of the connection member; furthermore, the non-return ratchet type torque socket can be applied in a manual, pneumatic or electric rotation tool, the application range is widened therefore the present invention is novel comparing to conventional art.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific examples of the embodiments disclosed and that modifications and other embodiments are intended to be included within the scope of the appended claims. Although specific terms are employed herein, they are used in a generic and descriptive sense only and not for purposes of limitation.

What is claimed is:

1. A non-return ratchet type torque socket, comprising:

a shaft rod, radially formed with a flange, two sides of said flange being respectively and axially extended with an insertion tenon having a noncircular cross section and a core shaft having a circular cross section, one surface of said core shaft being axially formed with at least a cut groove; said core shaft being respectively sleeved with a resilient member abutted against said flange, and a mobile ratchet capable of axially moving on said core shaft and radially annularly formed with unidirectional mobile ratchet teeth;

a shaft cylinder, two axial sides thereof being respectively formed with a shaft slot having a circular cross section and a sleeve slot having a noncircular cross section, said shaft slot being a stepped hole allowing said core shaft to be sleeved, and an interior thereof being radially formed with an annular friction segment capable of packing said core shaft, thereby forming a preset torque value between said core shaft and said shaft slot; an accommodation slot being formed between the opened end of said shaft slot and said friction segment thereby allowing said mobile ratchet to be accommodated, and a fixed ratchet being radially and annularly formed with unidirectional fixed ratchet teeth and being inserted into the interior of said accommodation slot of said shaft slot, and said fixed ratchet teeth being mutually engaged with said mobile ratchet teeth;

wherein, when said core shaft rotating in said shaft slot and the applied torque exceeding said preset torque value, said core shaft idly rotating in said shaft slot, thereby enabling said mobile ratchet teeth of said mobile ratchet to be engaged and rotated along said fixed ratchet teeth of said fixed ratchet for axially and elastically moving so as to generate a sound;

wherein said shaft slot has said circular cross section, and each of said fixed ratchet and said mobile ratchet have an exterior having a circular cross section corresponding with said circular cross section of said shaft slot and said fixed ratchet and said mobile ratchet are inserted into said accommodating slot of said shaft slot.

2. The non-return ratchet type torque socket as claimed in claim 1, wherein said mobile ratchet is formed with at least a position limiting slot, and a position limiting pin is provided for penetrating said position limiting slot and being inserted a first pin hole radially formed on said core shaft, thereby enabling said mobile ratchet to axially and elastically move on said core shaft; said fixed ratchet is axially formed with at least a positioning slot, a positioning pin is provided for penetrating a second pin hole radially formed on the outer wall of said shaft slot and being inserted in said positioning slot, thereby preventing said fixed ratchet from rotating in said accommodation slot.

3. The non-return ratchet type torque socket as claimed in claim 1, wherein a surface of said core shaft is radially and protrudingly formed with a flange part, the interior of said shaft slot is formed with a buckle part corresponding to the location of said flange part and allowing said flange part to be buckled.

4. The non-return ratchet type torque socket as claimed in claim 1, wherein said resilient member is selected from a spring or a resilient disc.

5. The non-return ratchet type torque socket as claimed in claim 1, wherein the interior of said sleeve slot is mounted with a magnet.

6. The non-return ratchet type torque socket as claimed in claim 1, wherein said core shaft is axially formed with a shaft hole in communication with said cut groove, and said shaft hole is stored with lubricating oil.

7. The non-return ratchet type torque socket as claimed in claim 1, wherein said core shaft is formed with an oil storage zone at the periphery of each cut groove.

8. The non-return ratchet type torque socket as claimed in claim 1, wherein said insertion tenon of said shaft rod is inserted in an insertion slot of a connection rod formed at the bottom of a manual, pneumatic or electric rotation tool, said sleeve slot is used for sleeving and positioning a sleeve rod of a drive head, the free end of said drive head is formed with a tenon having a geometric shape.

* * * * *